United States Patent [19]

Koiner et al.

[11] Patent Number: 5,032,087

[45] Date of Patent: Jul. 16, 1991

[54] ELECTRICAL COUPLING DEVICE

[75] Inventors: Josef Koiner, Pommelsbrunn; Helmut Steinhardt, Nuremberg, both of Fed. Rep. of Germany

[73] Assignees: TRW Daut and Rietz GmbH and Co. KG, Nurenberg; Alfred Teves, GmbH, Frankfurt, both of Fed. Rep. of Germany; part interest to each

[21] Appl. No.: 283,946

[22] PCT Filed: Mar. 10, 1988

[86] PCT No.: PCT/EP88/00186

§ 371 Date: Nov. 28, 1988

§ 102(e) Date: Nov. 28, 1988

[87] PCT Pub. No.: WO88/08212

PCT Pub. Date: Oct. 20, 1988

[30] Foreign Application Priority Data

Apr. 4, 1987 [DE] Fed. Rep. of Germany ..... 3711464
Feb. 25, 1988 [DE] Fed. Rep. of Germany ..... 3805897

[51] Int. Cl.[5] ..... H01R 13/629

[52] U.S. Cl. ..... 439/341; 439/372; 439/680

[58] Field of Search ..... 439/152, 153, 155, 157, 439/160, 338, 341, 372, 376, 680, 681, 677

[56] References Cited

U.S. PATENT DOCUMENTS 3,668,605 6/1972 Albert ..... 439/341

FOREIGN PATENT DOCUMENTS

A0119951 9/1989 European Pat. Off. .
B1029900 7/1958 Fed. Rep. of Germany .
3407725 10/1985 Fed. Rep. of Germany ..... 439/372
1413232 12/1965 France .
A6406739 12/1964 Netherlands .

*Primary Examiner*—Eugene F. Desmond
*Attorney, Agent, or Firm*—Collard, Roe & Galgano

[57] ABSTRACT

In an electrical coupling device with one contact strip firmly secured, for example, to the frame of the unit, and with one socket strip lodged in a housing, and with means for preventing incorrect coupling, in order to achieve easy and safe connection, the socket strip housing is fitted to the frame by a pivot pin arranged at one end of the housing and has a slide groove in at least one lateral longitudinal wall. By displacing in the slide groove a sliding block carried by means of a lever hinged to the frame, the socket strip housing can be pivoted and locked in order to permit coupling of the strip contacts and socket contacts to the contact strip.

6 Claims, 4 Drawing Sheets

ELECTRICAL COUPLING DEVICE

DESCRIPTION OF THE INVENTION

The invention relates to an electrical coupling device with a blade rail rigidly arranged, for example on an appliance frame, and a socket rail accommodated in a casing, as well as with means for preventing wrong coupling.

In multi-pole electrical coupling devices, the plugging operations of the blade pins and socket bodies require the latter elements to be in an exactly aligned association with one another, as well as relatively high expenditure in terms of force. Furthermore, if such plugging is insufficiently deep, maintenance of the plug connection is not safely assured.

The problem of the invention is to make the plugging process and support of the plug connection easier and safer.

According to the invention, the casing of the socket rail is, for said purpose, adapted for suspension on the frame of the device by means of a jointed peg arranged at one end of the frame, and has a coulisse groove in at least one lateral longitudinal wall, for and coupling the contacts of the blade and socket rails, such casing of the socket rail is adapted for swinging against the blade rail and locking by displacing a coulisse block in the coulisse groove, such coulisse block being supported by a lever articulated on the frame of the device. According to the preferred embodiment of the invention, provision is made that the casing of the socket rail has in both lateral longitudinal walls a coulisse groove, such grooves having idential curves, and that two coulisse blocks, each block being supported by a lever, are simultaneously and synchronously guidable in the two coulisse grooves, one block in each groove. Usefully, the levers are embodied in the form of twin levers with lever arms of different length, whereby the short lever arms of such twin levers support the coulisse blocks. Furthermore, for the purpose of actuating the two twin levers simultaneously and uniformly, the free ends of the long lever arms of the two levers are rigidly connected with one another by a bridge. Now the plugging operations of the blade and socket rails can be effected by simply swinging the socket rail casing, the latter being suspended on the frame of the device by means of the jointed peg, against the blade rail by swinging the levers, whereby the required expenditure of force is low as a result of and in accordance with the lever arm ratios. Locking is accomplished by an excess stroke for the levers, the handling of which is facilitated by the bridge. In addition, provision is made that the levers are disengagable both in the position for holding the socket rail casing and in the position for releasing the latter, and lockable on the frame of the device and/or casing of the socket rail. For the purpose of such arresting, cams or moldings on the frame of the device, or on the casing of the socket rail may be used, which cams or moldings project into the path of movement of the levers and, by running over the latter, arrest such levers.

Finally, measures for plugging predetermined socket rails with blade rails are realizable in that, by way of example, the lateral walls of the socket rail casing have a plurality of recesses arranged axially one after the other, such recesses being adapted to become active with the help of coding pins rigidly arranged on the frame of the device. In order to avoid interference with the swinging motions of the socket rail casing, such recesses are, usefully, limited by circular segments having their common center disposed in the jointed pegs.

Furthermore, for the purpose of facilitating the entry or introduction of the coulisse blocks in the coulisse grooves, the latter have, at the entry end, a coulisse groove segment that is conically tapered in the direction of entry, with such tapered segment being joined by coulisse groove parts extending transversely in each case. The conical part of the coulisse groove permits an automatic alignment of the socket rail casing, whereas the transversely extending parts of the coulisse groove permit the lifting of the socket rail casing in the direction of the frame by passing by the coulisse blocks. The exact alignment of the socket body is additionally supported in that the socket body has curved rail segments rigidly arranged on the lateral longitudinal wall, such curved segments being supported on the frame of the device, in particular on the face side of the latter.

According to another feature of the coupling device, provision is made to form the twin levers and the bridge by a single-piece molded part, and the jointed pegs and/or the coulisse blocks by deep-drawn attachments arranged on the twin levers. Apart from the fact that this leads to a simpler embodiment of the twin levers swinging the socket rail casing, the single-piece attachment result in a solidification of the twin levers. According to a preferred embodiment, in order to prevent the jointed pegs from unintentionally exiting from the peg bearings, provision is made to cut a bendable flap on each of the attachments forming the jointed pegs, which flaps immerse in annular grooves joining the peg bearings, and serve as axial support members for the twin levers.

In addition, an axial fixation of the twin levers on the lateral wings of the device frame is also realizable by making provision that each of the attachments forming the jointed pegs has an outward bulging, and that the associated joint peg bearings each have a passage opening for the bulgings of the attachments, such passages being displaced relative to the operating and idle positions of the twin levers and joined with the joint peg bearing in each case. Inserting the attachments in the jointed peg bearing or their removal from the latter is possible by simply bringing bulgings and passage openings for the latter in alignment with one another.

The invention is explained in greater detail by reference to the embodiment shown in the drawing, in which.

Figure 1:
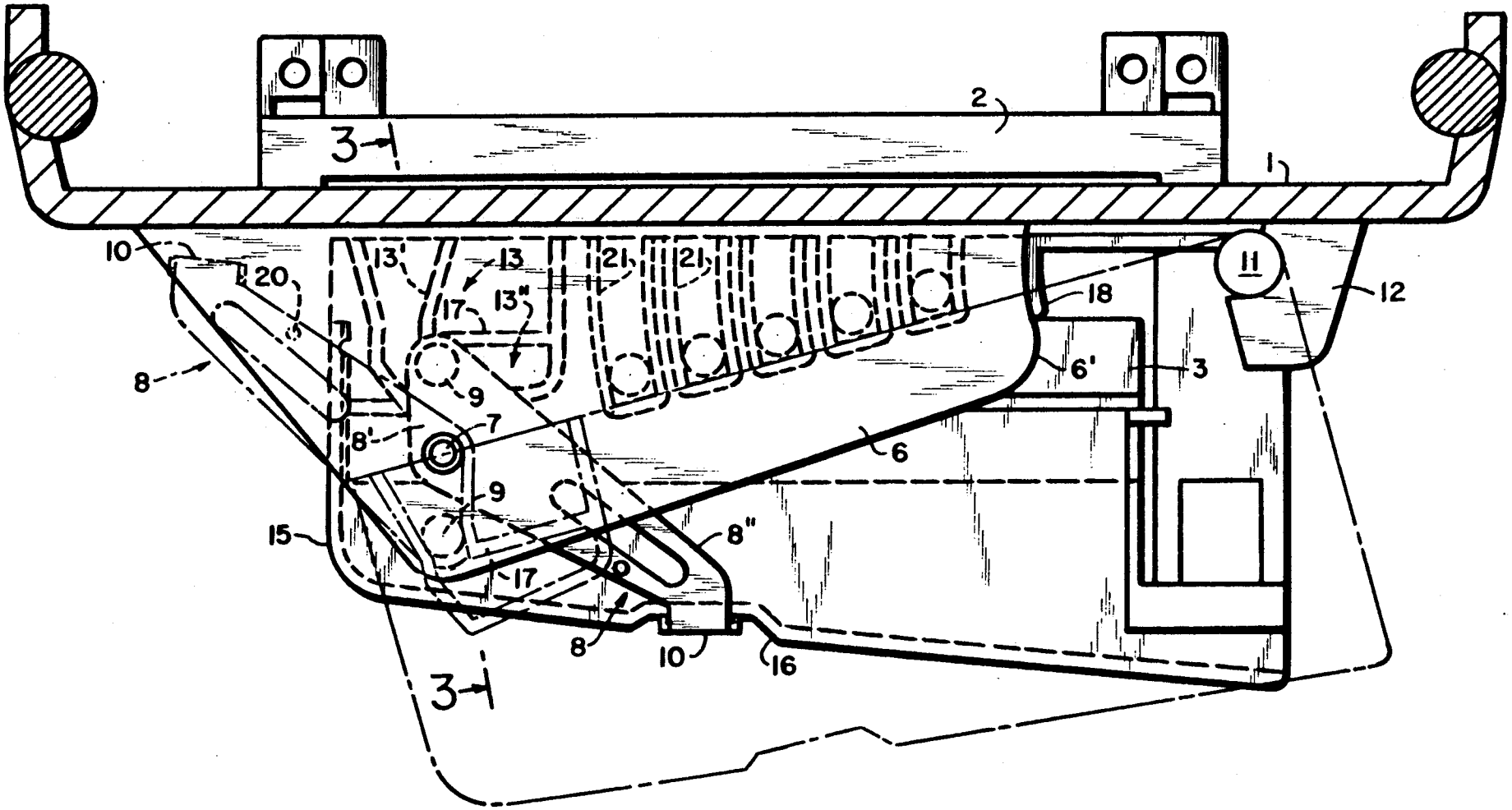
FIG. 1 shows a lateral view of a coupling device.
Figure 2:
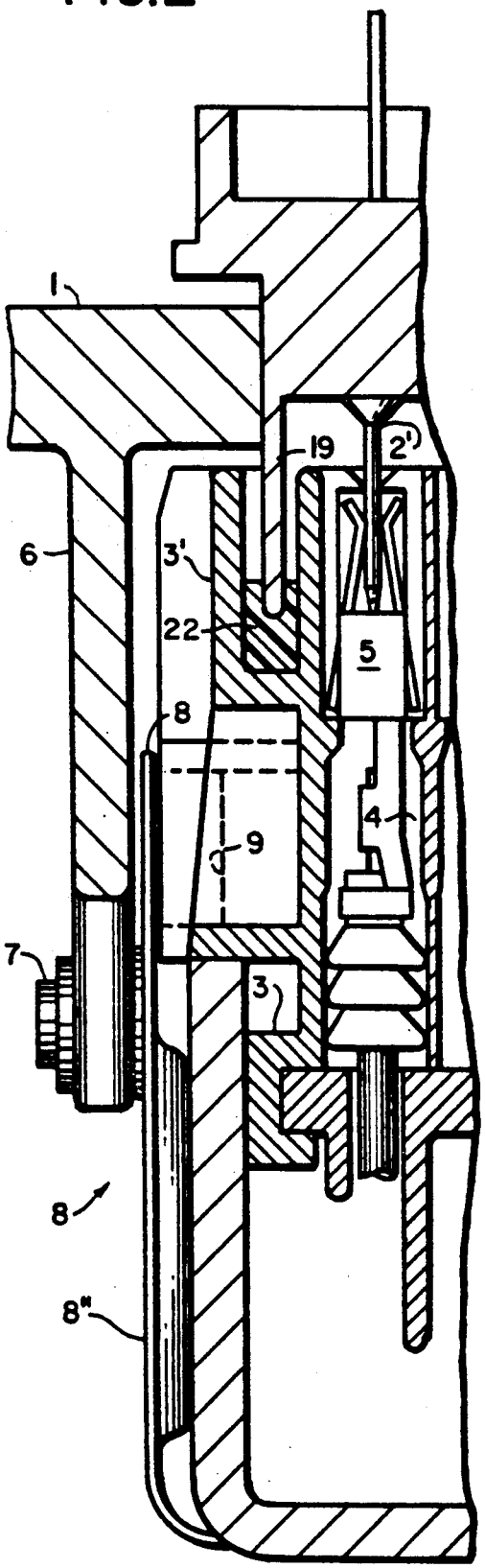
FIG. 2 shows an enlarged sectional view of part of a coupling device.
Figure 3:
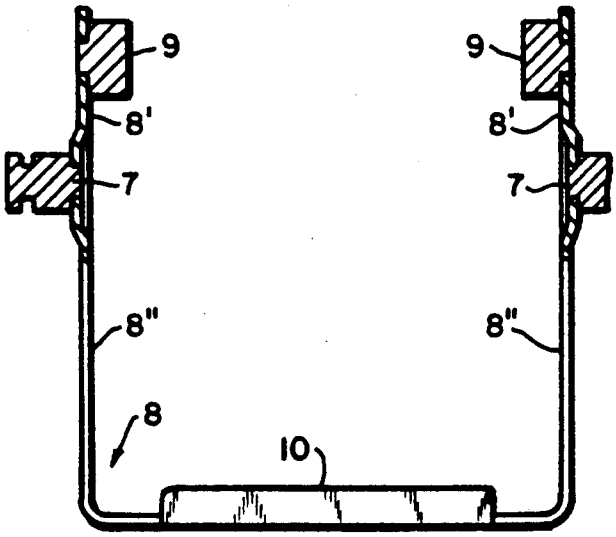
FIG. 3 is a sectional view of an embodiment of the lever with a cut along line III—III in FIG. 1.

In FIG. 1, reference numeral 1 denotes a device frame which, by way of example, may be arranged in a motor vehicle. The device frame 1 supports a multi-pole blade rail 2, which is rigidly connected with the device frame 1, for example by threaded bolts or screws. Reference numeral 3 denotes a socket rail casing accommodating (FIG. 2) in the recesses 4 a plurality of socket bodies 5 to be brought into contact with the blade pins 2'. On the frame 1 of the device, the lateral wings 6 are arranged parallel with a spacing, such wings accommodating between each other the socket rail casing 3. On the lateral wings 6, the twin levers 8 with the lever arms 8', 8", the latter being of different length, are articulated on such wings, their shorter lever arms 8' each supporting a pin 9 serving as the coulisse block, and their long lever arms 8" being rigidly connected with each other at the free end by means of a bridge 10. The levers 8 (FIG. 3) forming a single-piece molded part are adapted for swinging from a release position—shown in FIG. 1 by dash-dotted lines—into the fully drawn coupling position, and vice versa. By means of the jointed pegs 11, the socket rail casing 3 is, with its one end, adapted for suspension and swinging on the moldings 12 of the frame 1 of the device. In the socket rail casing 3, the coulisse grooves 13 are arranged in the lateral longitudinal walls 3', such grooves being formed by a conical coulisse groove segment 13' and a coulisse groove segment 13" with substantially parallel limiting walls, the latter segment extending crosswise relative to the former. In addition, the socket rail casing 3 accommodates the circular segment-shaped recesses 21, or chambers serving as parts of a coding system for accommodating the coding pins 14, the latter being arranged on the lateral wings 6. The socket rail casing 3 is rigidly joined with a covering cap 15.

For coupling the blade and socket rails, the socket rail body 3 first assumes the dash-dotted position (in FIG. 1) by suspending the jointed pegs 11 in the moldings 12. The levers 8, too, are disposed in the dash-dotted release position. By swinging the socket rail casing 3 in the clockwise direction, the pins 9 of the levers 8 are moved into the coulisse grooves 13, whereby the conical segments 13' of the coulisse groove contribute to the alignment of the socket rail casing 3. By swinging the levers 8 against the clockwise direction, i.e., anticlockwise, the pins 9 are moved into the coulisse groove segments 9" and cause the socket rail casing 3 to approach the blade rail 2, whereby the socket rail casing assumes the fully drawn position of FIG. 1. In this position, the bridge 10 comes to rest in a deepening (16) of the covering cap 15. At the same time, the levers 8 are fixed by an excess stroke and by means of the moldings 17 arranged on the limiting surfaces of the coulisse groove segment 9'. As the socket rail casing 3 is swung against the device frame 1, its alignment is promoted by the curved strips 18, which are arranged on the socket rail casing 3 and supported on the face side ends 6' of the lateral wings 6. After the socket rail casing 3 has been swung against the frame 1, the socket bodies 5 receive the associated blade pins 2', and tight coupling is achieved by pressing an edge strip 19, the latter being arranged on the blade rail 2, against a sealing body 22 in the socket rail casing 3. By having the coding pins 14 running up against limitations of the recesses 21 and due to the support of the strips 18 on the lateral wings 6, the plugged position is always the same, which permits avoiding damage to the levers 8 or blade pins 2' and to the socket bodies 5.

When the levers 8 swing back, the pins 9 move from the coulisse grooves 13 for releasing the socket rail casing 3, permitting the latter to be pulled off the blade rail 2 and to be removed from the device frame 1. The moldings 20 arranged on the lateral wings 6 serve for fixing the levers 8 in the release position for the socket rail casing 3.

Figure 4:
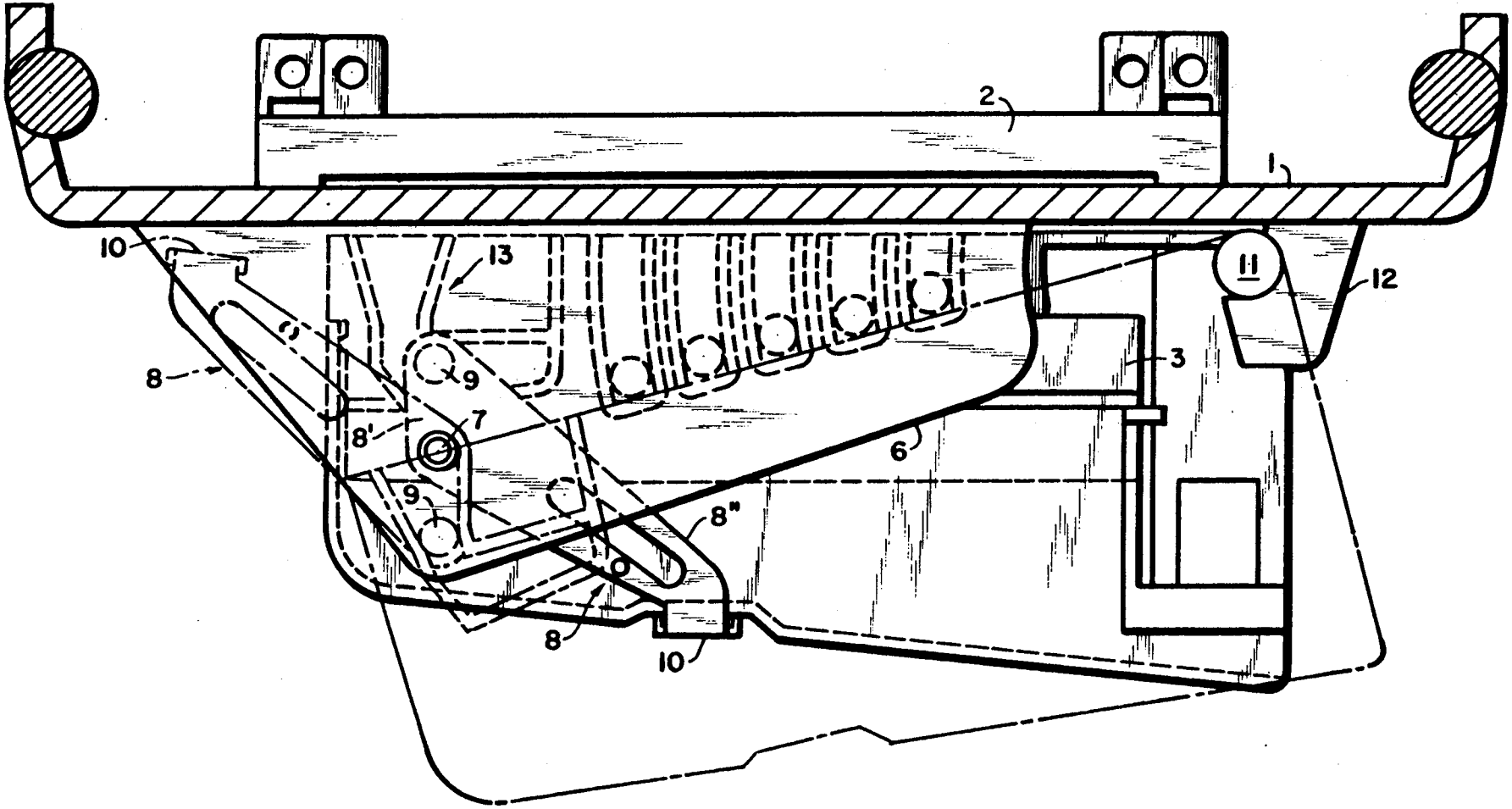
FIG. 4 shows a lateral view of a coupling device.
Figure 5:
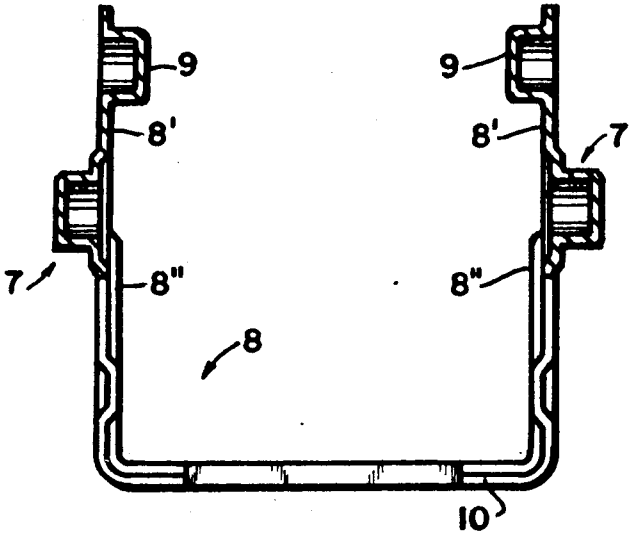
FIG. 5 is a partly sectional view of a molded part formed by twin levers.

In FIG. 4, the twin levers 8 having the lever arms 8', 8" of different length are pivoted by means of the joint pegs 7 on the lateral wings 6 of the device frame 1, with their lever arms 8' each supporting again a coulisse block 9 and their lever arms 8" being rigidly connected with one another at the free end by a bridge 10. The levers 8, which in this way form a single-piece molded part (FIG. 5), are adapted for swinging from a release position for the socket rail casing 3, such position being drawn in FIG. 4 by dash-dotted lines, into the fully drawn coupling position for coupling the blade pins of the blade rail and the socket bodies of the socket casing 3, and vice versa. By means of the jointed pegs 11, the socket rail casing 3 is, with its one end, adapted for suspension and swinging on the moldings 12 of the device frame 1. In the socket rail casing 3, the coulisse grooves 13 are formed in the longitudinal side walls for receiving the coulisse blocks 9 for swinging motions of the socket rail casing 3.

In the embodiment according to FIGS. 4 to 10, the coulisse blocks 9 and the jointed pegs 7 are formed by deep-drawn attachments (FIG. 5) and thus forming one single piece with the lever arms 8.

Figure 7:
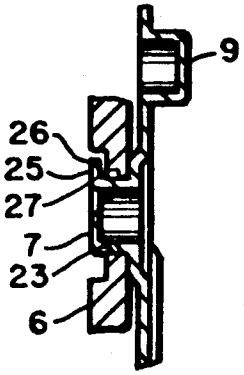
FIG. 7 is a partly sectional view of a jointed peg according to one embodiment.
Figure 8:
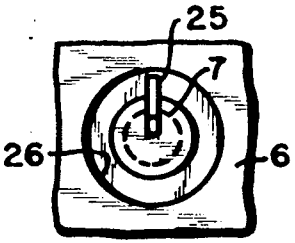
FIG. 8 shows a front view of a jointed peg.

In FIGS. 7 and 8, a flap 25 is cut on each of the jointed pegs 7, which flaps are bent back for preventing the jointed pegs 7 from unintentionally sliding out of the jointed peg bearings 23. Preferably, for preventing sections of the pegs 7 from projecting beyond the lateral wings 6, the flaps 25 immerse in the annular grooves 26 with play and come to rest on the inner limiting surfaces 27 of the annular grooves 26.

Figure 10:
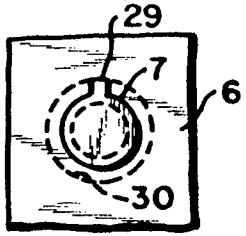
FIG. 10 shows a front view of the jointed peg shown in FIG. 9.
Figure 6:
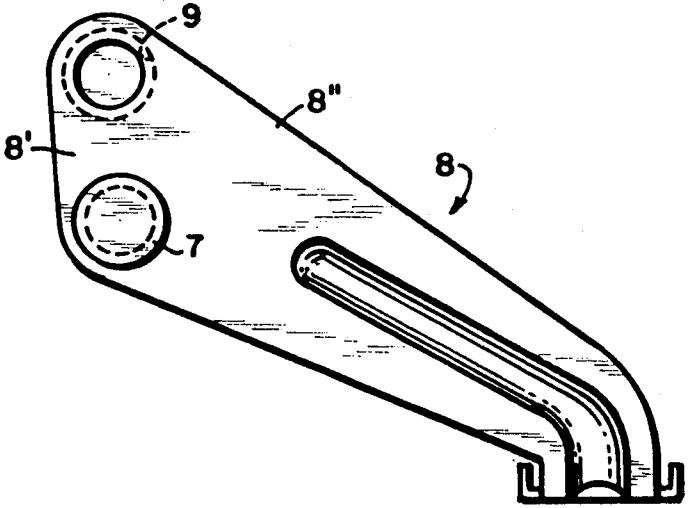
FIG. 6 is a lateral view of a molded part formed by twin levers.
Figure 9:
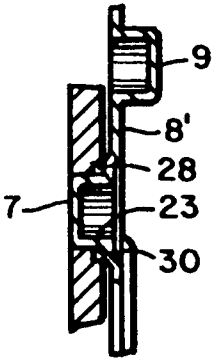
FIG. 9 is a partly sectional view of a jointed peg of another embodiment.

In the embodiment according to FIGS. 9 and 10, each of the jointed pegs 7 supports within the zone of the circumferential surface an attachment or a bulging 28 which, by way of the passage openings 29—the latter being displaced from the release position and the operating position of the socket rail casing—immerse in undercut annular grooves 30, permitting the twin levers 8 to swing freely. By means of the attachments 28 and the annular grooves 30, the jointed pegs 7 are axially fixed on the lateral wings with play, which prevents such pegs 7 from unintentionally sliding out of the peg bearings 23.

We claim:

1. Electrical coupling device with a blade strip rigidly arranged on the frame of an equipment and a socket strip accommodated in a casing, comprising:

the blade strip and the casing of the socket strip have two face side ends and are, within the zone of the one face side end swivel-mounted on each other by means of a fastening hook and a holding part, and adapted to swivel against each other with the other face side end by an elbow lever fitted with link blocks, and link grooves;

wherein the casing of the socket strip is suspendable on the frame of the equipment by link pins and supportable on the frame of the equipment with bow-shaped strip sections;

wherein the casing of the socket strip having lateral longitudinal walls can be swivelled against and locked on the blade strip by means of an elbow lever with coulisse link blocks guided in the lateral longitudinal walls of the casing of the socket strip, said lever being hinged on the frame of the equipment; and wherein the elbow lever is detachably lockable in the working and release positions of the socket strip casing by elements integrally molded on the equipment frame or socket strip casing.

2. The electrical coupling device as defined in claim 1, wherein there are two levers which are embodied as twin levers with lever arms of a shorter length and a longer length, the shorter lever arms of such twin levers supporting the coulisse link blocks.

3. The electrical coupling device as defined in claim 2, wherein the longer lever arms have a free end; and the free ends of the longer lever arms of the two levers are rigidly connected with one another by a bridge.

4. The electrical coupling device as defined in claim 1, further comprising coulisse grooves have an empty end and at the entry end, said coulisse grooves having a coulisse groove segment conically tapering off in the direction of introduction, such tapered segments being joined in each case by a transversely extending coulisse groove segment.

5. The electrical coupling device as defined in claim 1, wherein there is a socket rail casing having lateral longitudinal walls and said lateral longitudinal walls of the socket rail casing have a plurality of recesses disposed axially one after the other, such recesses being capable of being engaged by means of coding pins rigidly arranged on the frame of the device.

6. The electrical coupling device as defined in claim 1, wherein there is a socket rail casing on the lateral longitudinal walls, the socket rail casing has curved strip segments rigidly joined with such casing and supportable on the frame of the device.

* * * * *

UNITED STATES PATENT AND TRADEMARK OFFICE

CERTIFICATE OF CORRECTION

PATENT NO. : 5,032,087

DATED : July 16, 1991

INVENTOR(S) : Josef KOINER ET AL

It is certified that error appears in the above-identified patent and that said Letters Patent is hereby corrected as shown below:

Cover page, column 1, item 73, line 2, delete "Nurenberg" and substitute therefor --Nurnberg--.

Signed and Sealed this

Twenty-sixth Day of November, 1991

*Attest:*

HARRY F. MANBECK, JR.

*Attesting Officer*

*Commissioner of Patents and Trademarks*